US009893436B2

(12) United States Patent
Martin

(10) Patent No.: US 9,893,436 B2
(45) Date of Patent: Feb. 13, 2018

(54) CLAMP AND CLAMP ASSEMBLY

(71) Applicant: Hubbell Incorporated, Shelton, CT (US)

(72) Inventor: Evan R. Martin, Derry, NH (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 15/187,572

(22) Filed: Jun. 20, 2016

(65) Prior Publication Data

US 2016/0372842 A1 Dec. 22, 2016

Related U.S. Application Data

(60) Provisional application No. 62/182,257, filed on Jun. 19, 2015.

(51) Int. Cl.
*H01R 4/64* (2006.01)
*H01R 4/26* (2006.01)

(52) U.S. Cl.
CPC *H01R 4/26* (2013.01); *H01R 4/64* (2013.01)

(58) Field of Classification Search
CPC ..... H01R 4/64; H01R 4/646; H01R 4/643; H01R 4/60; H01R 13/518; H01R 25/14; H01R 25/142; H01R 4/36; H01R 4/363; H01R 4/366; F16B 37/045
USPC ..... 439/100, 99, 810–812, 532, 110; 411/84
See application file for complete search history.

(56) References Cited

U.S. PATENT DOCUMENTS 3,551,876 A * 12/1970 Walter ..... H01R 9/2675 439/110
3,701,839 A * 10/1972 Smith ..... H01R 4/26 174/78
3,778,749 A * 12/1973 Kapell ..... H01R 4/646 174/78
4,176,893 A * 12/1979 Olszewski ..... H01R 4/646 439/411
4,353,612 A * 10/1982 Meyers ..... H01R 4/646 439/411
4,449,768 A * 5/1984 Koncelik ..... H01R 4/646 439/391

(Continued)

FOREIGN PATENT DOCUMENTS

CN 204206071 3/2015

OTHER PUBLICATIONS

PCT/US2016/038423 International Search Report and Written Opinion dated Oct. 28, 2016 (17 pages).

*Primary Examiner* — Gary Paumen
(74) *Attorney, Agent, or Firm* — Michael Best & Friedrich, LLP

(57) ABSTRACT

A connector configured to mechanically and electrically couple a first frame to a second frame includes a body, a first clamping member, a second clamping member, and a plurality of projections extending from the body and configured to contact at least one of the first frame and the second frame. The body includes a first end and a second end and defines a longitudinal axis extending between the first end and the second end. The body further includes a feature for engaging a fastener. The first clamping member is positioned adjacent the first end of the body and is configured to engage the first frame. The second clamping member is positioned adjacent the second end of the body and is configured to engage the second frame.

18 Claims, 6 Drawing Sheets

(56) References Cited

U.S. PATENT DOCUMENTS

| | | | | |
|---|---|---|---|---|
| 4,561,708 | A * | 12/1985 | Sorlien | H01R 4/646 439/393 |
| 4,895,525 | A * | 1/1990 | Leonardo | H01R 4/646 439/99 |
| 5,358,423 | A * | 10/1994 | Burkhard | H01R 4/2454 24/336 |
| 5,893,763 | A * | 4/1999 | O'Connor | H01R 9/2466 439/532 |
| 8,353,650 | B2 | 1/2013 | Wiley et al. | |
| 8,505,864 | B1 | 8/2013 | Taylor et al. | |
| 8,864,504 | B1 * | 10/2014 | Gretz | H01R 4/66 439/100 |
| 2003/0036297 | A1 * | 2/2003 | Kilkenny | H01R 25/145 439/110 |
| 2003/0206785 | A1 * | 11/2003 | Hoffmann | F16B 37/045 411/84 |
| 2010/0130055 | A1 * | 5/2010 | Liang | E04B 9/068 439/532 |
| 2010/0276558 | A1 | 11/2010 | Faust et al. | |
| 2013/0143423 | A1 * | 6/2013 | Luksic | H01R 25/142 439/116 |
| 2014/0311552 | A1 | 10/2014 | Garrett | |
| 2015/0101655 | A1 | 4/2015 | Schult et al. | |
| 2015/0249423 | A1 | 9/2015 | Braunstein et al. | |
| 2016/0006390 | A1 | 1/2016 | Cinnamon et al. | |

* cited by examiner

CLAMP AND CLAMP ASSEMBLY

REFERENCE TO RELATED APPLICATION

This application claims the benefit of prior-filed, U.S. Provisional Patent Application No. 62/182,257, filed Jun. 19, 2015, the entire contents of which are hereby incorporated by reference.

BACKGROUND

The present disclosure relates to a connector that is connectable to a support structure, and particularly a connector for mechanically and electrically coupling a frame to a support structure.

SUMMARY

In one embodiment, a connector configured to mechanically and electrically couple a first frame to a second frame includes a body, a first clamping member, a second clamping member, and a plurality of projections extending from the body and configured to contact at least one of the first frame and the second frame. The body includes a first end and a second end and defines a longitudinal axis extending between the first end and the second end. The body further includes a feature for engaging a fastener. The first clamping member is positioned adjacent the first end of the body and is configured to engage the first frame. The second clamping member is positioned adjacent the second end of the body and is configured to engage the second frame.

In another embodiment, a connector configured to mechanically and electrically engage a support structure includes a first portion, a second portion coupled to the first portion, and an intermediate portion positioned between the first portion and the second portion. The first portion includes a distal end having a first plurality of projections. The second portion includes a distal end having a second plurality of projections. The intermediate portion couples the second portion to the first portion.

In yet another embodiment, a connector assembly configured to mechanically and electrically couple at least one frame to a support structure includes a first connector, a second connector, and a member coupling the first connector to the second connector. The first connector includes a body, a first clamping member, a second clamping member, and a plurality of projections extending from the body and configured to contact one of the at least one frame. The body includes a first end and a second end and defines a longitudinal axis extending between the first end and the second end. The body further includes a first aperture positioned between the first end and the second end. The first clamping member is positioned adjacent the first end of the body and is configured to engage one of the at least one frame. The second connector includes a first portion, a second portion coupled to the first portion, and an intermediate portion positioned between the first portion and the second portion. The first portion includes a distal end having teeth configured to engage the support structure. The second portion includes a distal end having teeth configured to engage the support structure. The intermediate portion couples the second portion to the first portion and includes a second aperture.

In still another embodiment, a connector is configured to mechanically and electrically couple a first frame to a second frame and including a body that has a longitudinal axis and an aperture that extends therethrough. The connector also includes a first clamping member that extends from a first end of the body, a second clamping member that extends from a second end of the body, and a plurality of bonding projections that extend from the body. The first clamping member is configured to be coupled to one of the first frame or the second frame and the second clamping member is configured to be coupled to the other of the first frame or the second frame.

In still another embodiment, a connector is configured to mechanically and electrically couple to a support structure. The connector includes a body that has a longitudinal axis and a first portion that is coupled to a second portion by an intermediate portion therebetween. The intermediate portion includes an aperture extending therethrough and each of the first portion and the second portion include a surface having a plurality of projections extending therefrom.

In still another embodiment, a connector assembly is configured to mechanically and electrically couple adjacent frames to a support structure. The connector assembly includes a first connector configured to be coupled between a first frame and a second adjacent frame and a second connector configured to be coupled to the support structure. The first connector includes a body that has a longitudinal axis and an aperture that extends therethrough. The first connector also includes a first clamping member that extends from a first end of the body, a second clamping member that extends from a second end of the body, and a plurality of bonding projections that extend from the body. The first clamping member is configured to be coupled to one of the first frame or the second frame and the second clamping member is configured to be coupled to the other of the first frame or the second frame. The second connector includes a body that has a longitudinal axis and a first portion that is coupled to a second portion by an intermediate portion therebetween. The intermediate portion includes an aperture extending therethrough and each of the first portion and the second portion include a surface having a plurality of projections extending therefrom.

Other aspects of the disclosure will become apparent by consideration of the detailed description and accompanying drawings.

DETAILED DESCRIPTION

Figure 1:
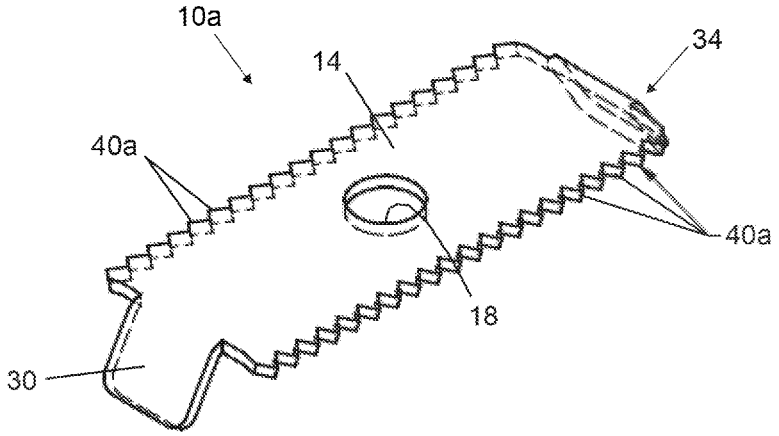
FIG. 1 is a perspective view of a first connector.
Figure 2:
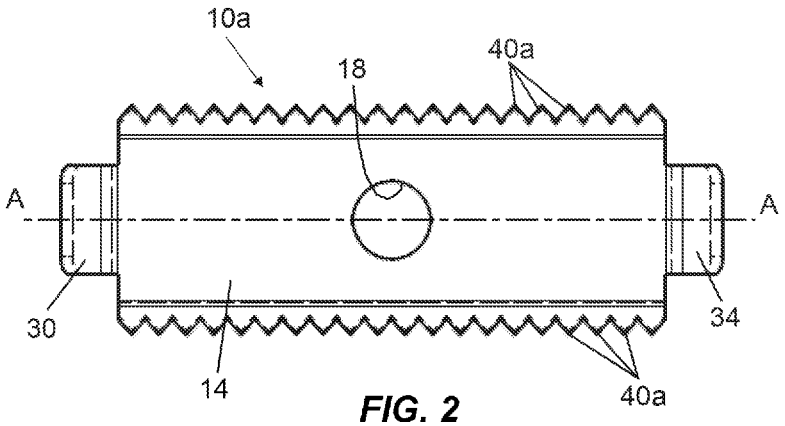
FIG. 2 is a plan view of the first connector of FIG. 1.
Figure 3:
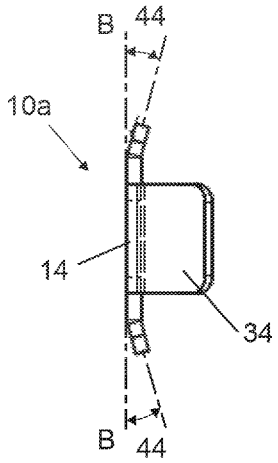
FIG. 3 is an end view of the first connector of FIG. 1.
Figure 4:
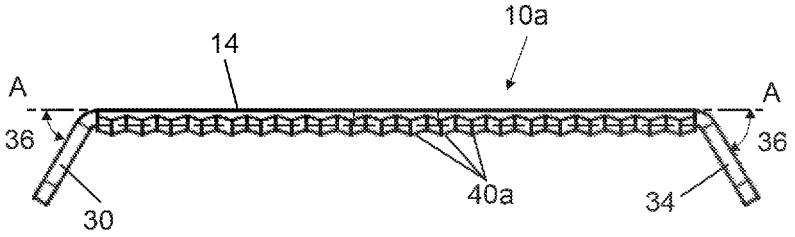
FIG. 4 is a side view of the first connector of FIG. 1.
Figure 5:
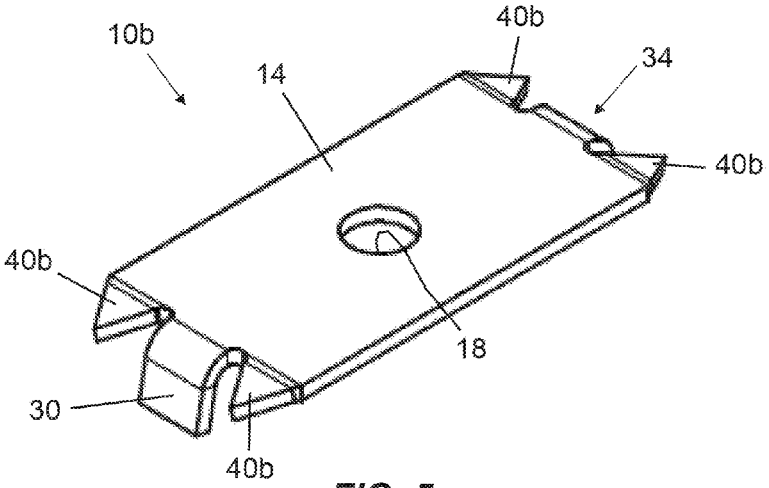
FIG. 5 is a perspective view of a first connector according to another embodiment.
Figure 7:
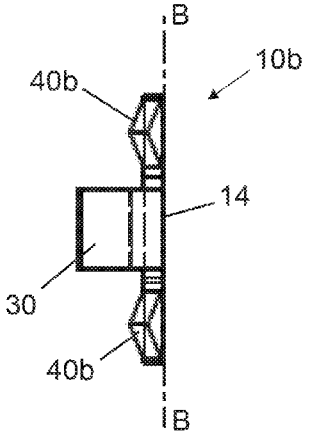
FIG. 7 is an end view of the first connector of FIG. 5.
Figure 6:
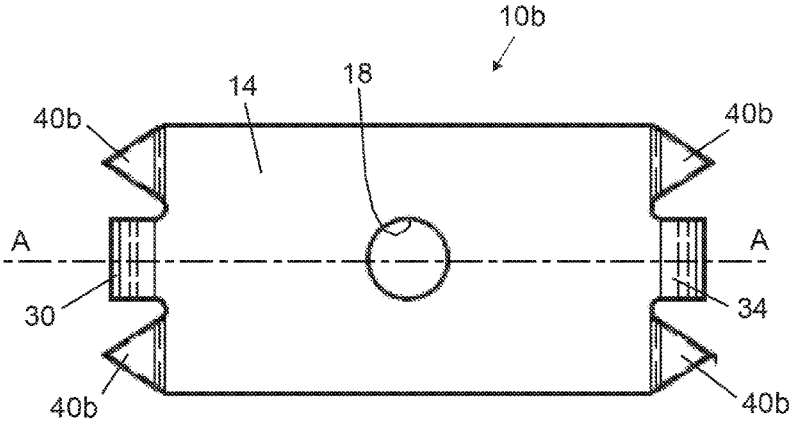
FIG. 6 is a plan view of the first connector of FIG. 5.
Figure 8:
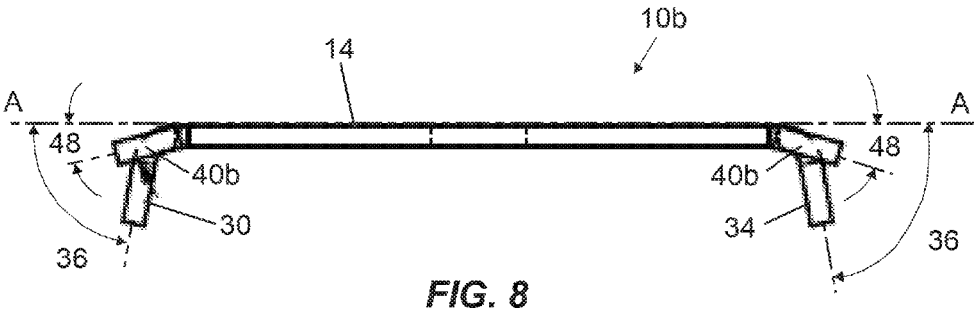
FIG. 8 is a side view of the first connector of FIG. 5.
Figure 9:
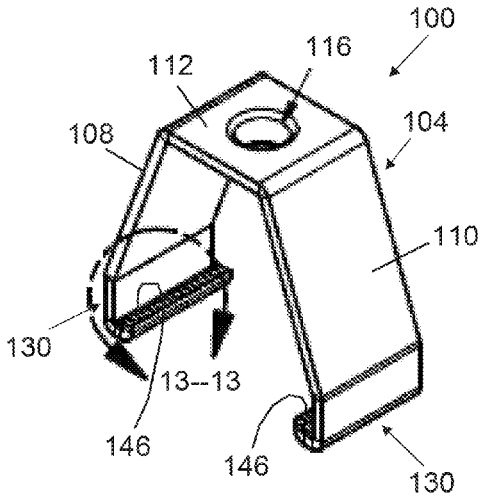
FIG. 9 is a perspective view of a second connector.

Before any embodiments of the disclosure are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical or hydraulic connections or couplings, whether direct or indirect. Also, electronic communications and notifications may be performed using any known means including direct connections, wireless connections, etc.

FIGS. 1-4 illustrate a first connector 10*a* including an elongated body 14. In the illustrated embodiment, the body 14 has a substantially planar or flat portion defining a plane B (Fig. B). The body 14 includes a first end and a second end, and a first longitudinal axis A extends between the first end and the second end. An aperture 18 extends through the body 14 in a direction perpendicular to the axis A (FIG. 2) and the plane B. A first clamping member 30 is positioned adjacent the first end of the body 14 and a second clamping member 34 is positioned adjacent the second end of the body 14. The clamping members 30, 34 extend from the first and the second ends, respectively. In the illustrated embodiment, each clamping member 30, 34 is oriented at an acute angle 36 with respect to the longitudinal axis A. In some embodiments, the angle 36 is between approximately 55 degrees and approximately 85 degrees. In some embodiments, the angle 36 is approximately 59 degrees. In some embodiments, the angle 36 is approximately 80 degrees.

The first connector 10 includes one or more first bonding projections 40*a*. In the embodiment of FIGS. 1-4, the first bonding projections 40*a* of the first connector 10*a* include a plurality of teeth 40*a* that extend from side edges of the body 14. Stated another way, the body 14 includes side edges extending between the first end and the second end, and the teeth 40*a* protrude outwardly from the side edges in a direction perpendicular to the axis A. In the illustrated embodiment, each of the teeth 40*a* protrudes at an acute angle 44 with respect to the plane B (FIG. 3) and relative to the axis A. The angle 44 is smaller than the angle 36 in the illustrated embodiment. In some embodiments, the angle 44 is between approximately 5 degrees and approximately 20 degrees. In some embodiments, the angle 44 is approximately 13 degrees. In some embodiments, there are twenty teeth 40*a* that extend from each side of the body 14. In other embodiments there may be fewer or more teeth on each side.

FIGS. 5-8 illustrate a first connector 10*b* according to another embodiment. Some aspects of the first connector 10*b* is similar to the first connector 10*a* described above with respect to FIGS. 1-4. For the sake of brevity, only the differences between the first connector 10*b* and the first connector 10*b* are described in detail. Similar features are identified with similar reference numbers and may be identified with a "b" suffix instead of an "a" suffix.

As shown in FIGS. 5-8, the first bonding projections 40 of the first connector 10*b* include teeth 40*b* positioned on the ends of the body 14. In the illustrated embodiment, each end includes a pair of teeth 40*b*, and the teeth 40*b* of each end are positioned on each side of the clamping members 30, 34. In addition, the teeth 40*b* on each end of the body 14 protrude from the first and the second ends at an acute angle 48 with respect to the plane B and relative to the axis A. In the illustrated embodiment, the angle 48 is smaller than the angle 36. In some embodiments, the angle 48 is between approximately 5 degrees and approximately 20 degrees. In some embodiments, the angle 48 is approximately 17 degrees.

In the embodiment of FIGS. 1-4 and the embodiment of FIGS. 5-8, the first connector 10*a*, 10*b* is symmetrical about the axis A. The first connectors 10*a*, 10*b* are also symmetric about an axis that is transverse to the axis A and parallel to the plane B. In some embodiments, the first connector 10*a*, 10*b* is manufactured from stainless steel. In other embodiments, the first connector 10*a*, 10*b* may be manufactured from another suitable material.

The first connector 10*a*, 10*b* of both the embodiment of FIGS. 1-4 and the embodiment of FIGS. 5-8 are configured to mechanically secure adjacent frames (e.g., photovoltaics (PV) modules—not shown), and also to electrically bond or provide electrical communication between the frames, each of which has a non-conductive coating of aluminum (e.g., oxide, paint, or anodization). In particular, the first clamping member 30 may engage or be coupled to a first PV module and the second clamping member 34 may engage or be coupled to a second PV module, while the first bonding projections (e.g., the teeth 40*a*, 40*b*) pierce the non-conductive coating of aluminum. Accordingly, the above-described first connectors 10*a*, 10*b* mechanically and electrically couple adjacent frames, such as PV modules, to one another.

With respect to FIGS. 14-21, both of the first connector 10*a*, 10*b* described above can also be coupled to a claw member or second connector 100. The components of the second connector 100 are described below.

Referring now to FIGS. 9-13, the second connector 100 includes a body 104. The body 104 has a first end and a second end. A second longitudinal axis C (FIG. 10) extends between the first end and the second end. In the illustrated embodiment, the second axis C is substantially parallel to the first axis A. The second connector 100 further includes a first portion 108 that is coupled to or integrally formed (i.e., formed as one piece) with a second portion 110. In the illustrated embodiment, the first portion 108 and the second portion 110 are both integrally formed with an intermediate portion 112 therebetween. Each of the first portion 108 and the second portion 110 extend at an acute angle 114 relative to the intermediate portion 112. An aperture 116 extends through the intermediate portion 112.

Figure 10:
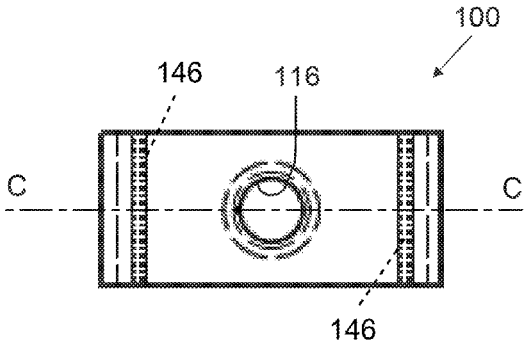
FIG. 10 is a plan view of the second connector of FIG. 9.
Figure 11:
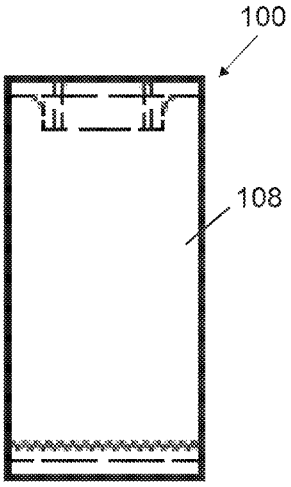
FIG. 11 is an end view of the second connector of FIG. 9.
Figure 12:
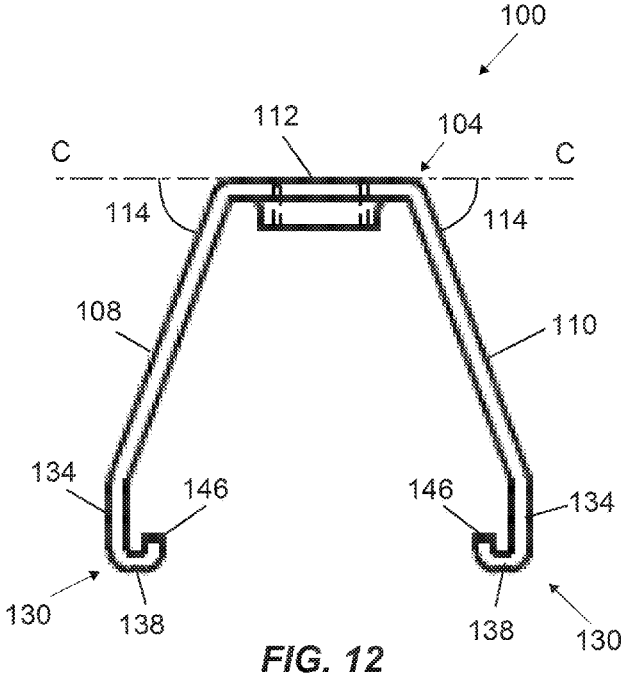
FIG. 12 is a side view of the second connector of FIG. 9.
Figure 13:
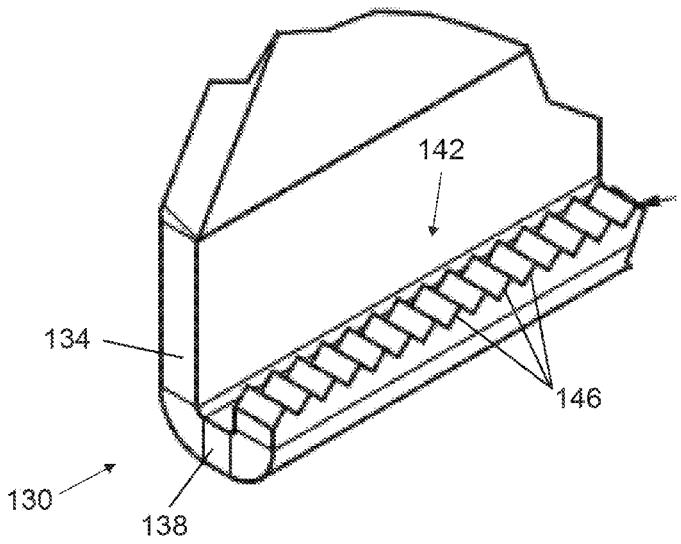
FIG. 13 is an enlarged perspective view of portion 13-13 of the second connector of FIG. 9.
Figure 14:
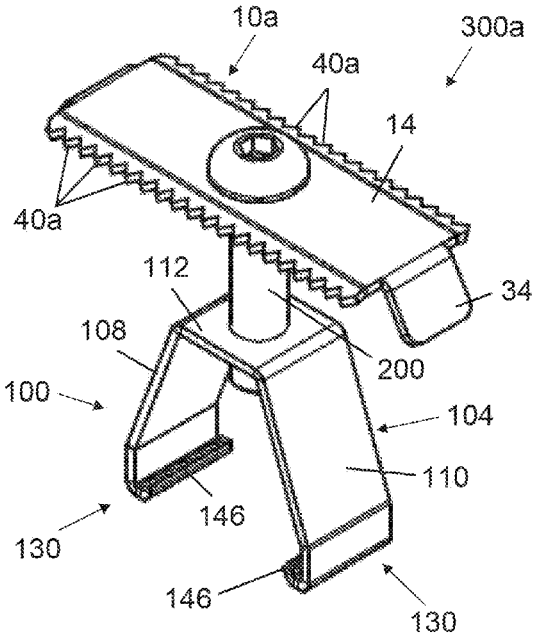
FIG. 14 is a perspective view of a connector assembly including the first connector of FIGS. 1-4 and the second connector of FIGS. 9-13.

As best shown in FIGS. 12 and 13, each of the first and the second portions 108, 110 includes a distal end with a hooked portion 130 having a leg 134 and a substantially U-shaped portion 138. In the illustrated embodiment, the U-shaped portion 138 is oriented inwardly such that the U-shaped portion 138 of each hooked portion 130 curve toward one another. Each hooked portion 130 includes a terminal surface 142 with second bonding projections 146. In the illustrated embodiment, the second bonding projections 146 include a plurality of teeth protruding from the terminal surface 142. The surface 124 extends perpendicular to the longitudinal axis C (FIG. 10).

In some embodiments, the second connector 100 is manufactured from stainless steel. In other embodiments, the second connector 100 may be manufactured from another suitable material. The second connector 100 is configured to engage a support structure (not shown) that is manufactured from aluminum, steel, or any other suitable metallic material.

As shown in FIGS. 14-21, a connector assembly 300 is formed by coupling one of the first connectors 10*a*, 10*b* to the second connector 100. In the illustrated embodiment, the first connector 10*a* or 10*b* is coupled to and spaced apart from the second connector 100 by a fastener 200. In the illustrated embodiment, the first longitudinal axis A of the first connectors 10*a*, 10*b* is parallel to the second longitudinal axis C of the second connector 100 when the connectors 10, 100 are coupled together. The fastener passes through the aperture 18 of the first connectors 10*a*, 10*b* and the aperture 116 of the second connector 100.

The fastener 200 may be constructed from steel or another suitable metallic or electrically-conductive material. In some embodiments, the fastener 200 is a threaded fastener that is threadingly coupled to the second connector 100 (i.e., the aperture 116 may be threaded). In other embodiments, the fastener 200 is a rivet that couples the first connector 10 to the second connector 100. In still other embodiments, the fastener 200 may be another type of fastener (e.g., a screw, a bolt, etc.). In still other embodiments, the first connectors 10 and the second connector may be coupled together in a difference manner.

Figure 15:
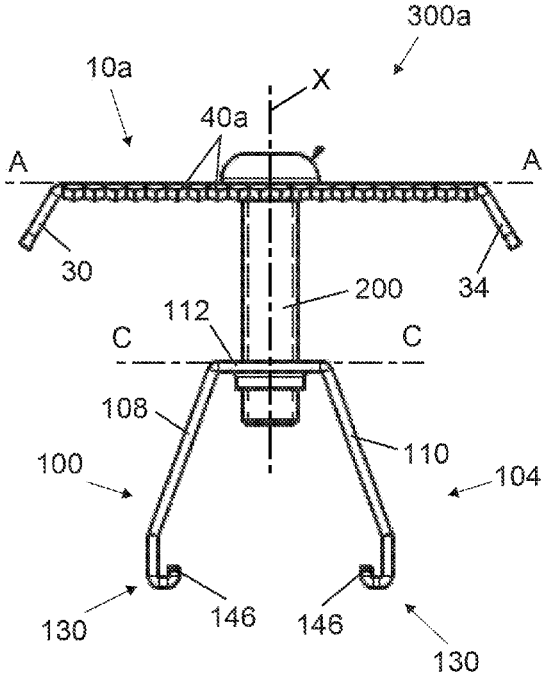
FIG. 15 is a side view of the connector assembly of FIG. 14.
Figure 17:
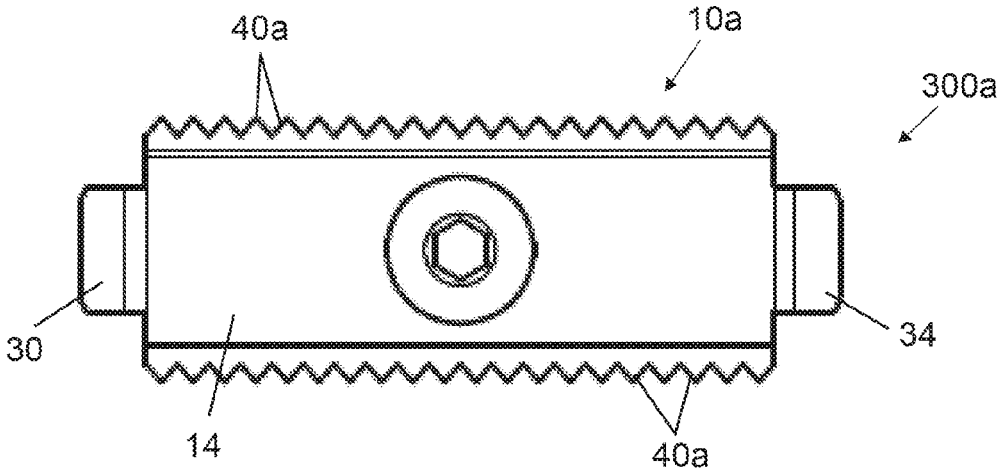
FIG. 17 is a plan view of the connector assembly of FIG. 14.
Figure 16:
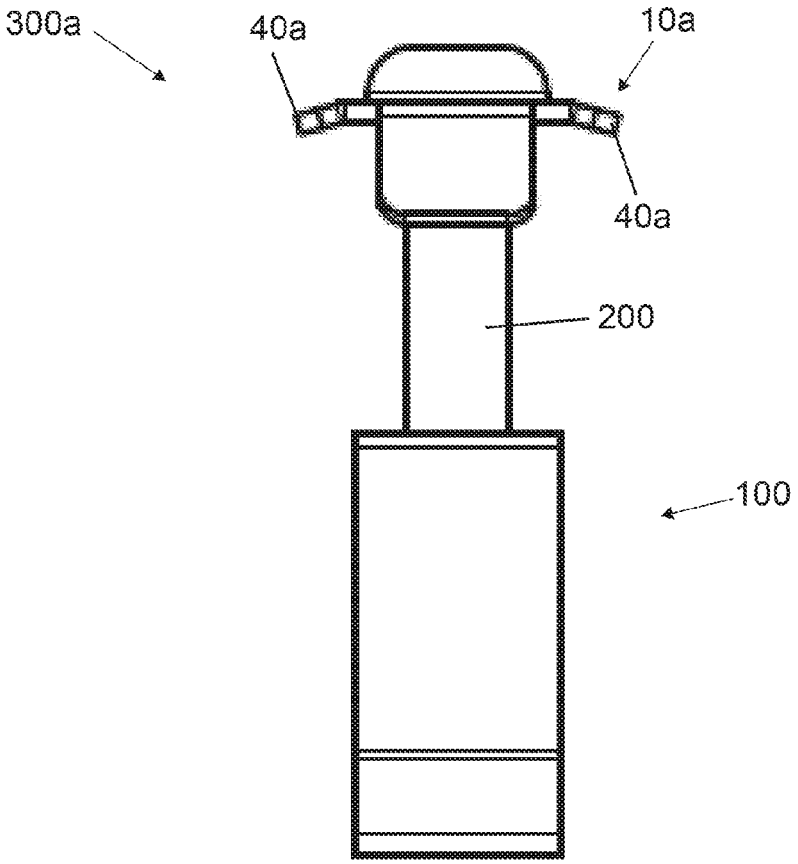
FIG. 16 is an end view of the connector assembly of FIG. 14.
Figure 18:
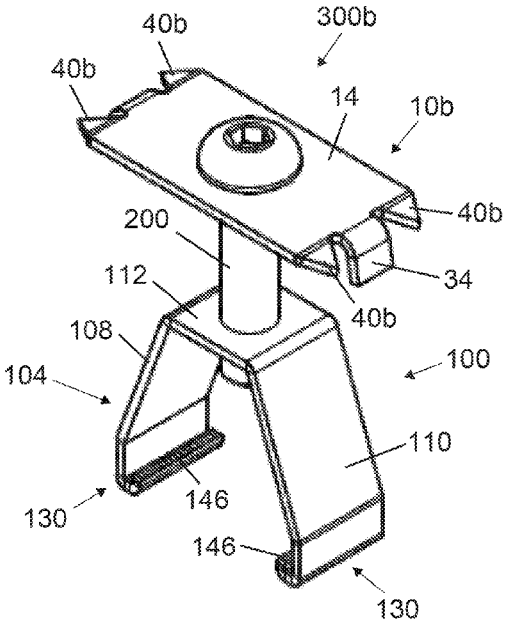
FIG. 18 is a perspective view of a connector assembly including the first connector of FIGS. 5-8 and the second connector of FIGS. 9-13.
Figure 19:
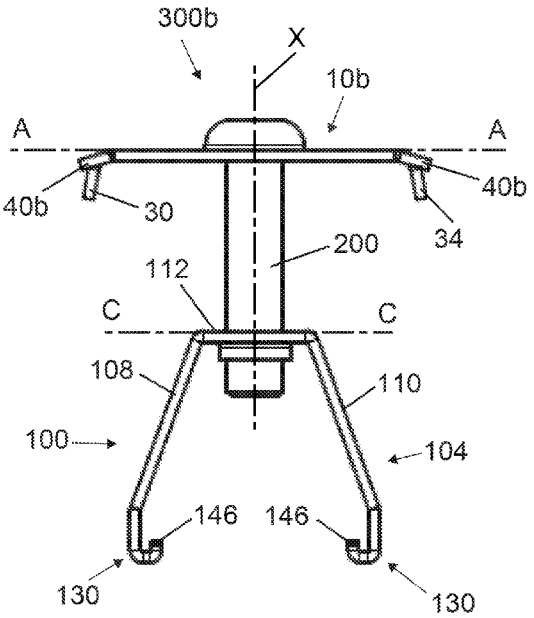
FIG. 19 is a side view of the connector assembly of FIG. 18.
Figure 20:
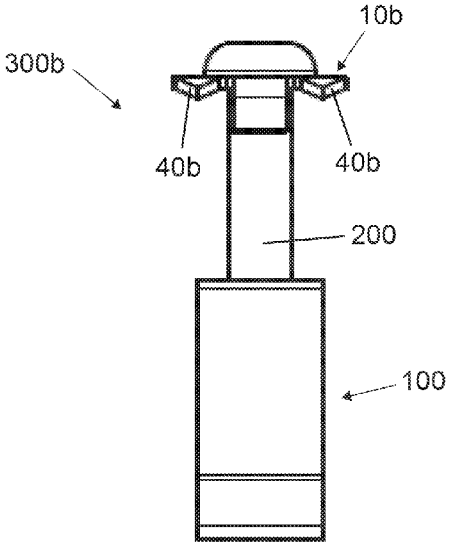
FIG. 20 is an end view of the connector assembly of FIG. 18.
Figure 21:
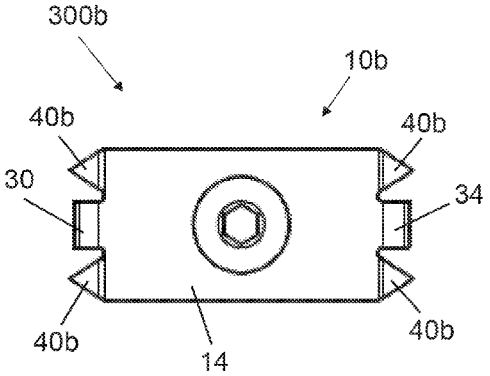
FIG. 21 is a plan view of the connector assembly of FIG. 18.

In use, the connector assembly 300 couples adjacent PV modules to a support structure. For example, the portions 108, 110 of the second connector 100 are positioned in a channel or slot (not shown) on opposite sides of a rail of the support structure, and the bonding projections 146 or teeth pierce the rail. The second connector 100 extends away from the rail, providing a stand-off for the first connector 10. The first connector 10 is spaced apart from the second connectors 100 and aligned with the second connector 100 along an axis X (FIGS. 15 and 19). The first connector 10 is coupled between adjacent PV module frames, as discussed above. Once both the first connector 10 and the second connector 100 are appropriately positioned, the fastener 200 secures the first connector 10 to the second connector 100 and couples the PV module frame to the support structure. The connectors 10, 100 provide mechanical and electrical coupling between the adjacent PV modules, and between the PV modules and the support structure.

Although certain aspects have been described in detail with reference to certain preferred embodiments, variations and modifications exist within the scope and spirit of one or more independent aspects as described. Various features and advantages of the disclosure are set forth in the following claims.

What is claimed is:

1. A connector configured to mechanically and electrically couple a first frame to a second frame, the connector comprising:

a body including a first end and a second end, the body defining a longitudinal axis extending between the first end and the second end, the body further including a feature for engaging a fastener;

a first clamping member positioned adjacent the first end of the body, the first clamping member configured to engage the first frame;

a second clamping member positioned adjacent the second end of the body, the second clamping member configured to engage the second frame; and a plurality of projections extending from the body and configured to contact at least one of the first frame and the second frame, wherein the body includes a first side and a second side, the first side and the second side extending between the first end and the second end and substantially parallel to the longitudinal axis, and wherein the plurality of projections includes a plurality of first projections and a plurality of second projections, the plurality of first projections extending from the first side, the plurality of second projections extending from the second side, the plurality of first projections configured to contact the first frame, the plurality of second projections configured to contact the second frame.

2. The connector of claim 1, wherein the plurality of first projections are oriented at an acute angle relative to the longitudinal axis, the plurality of second projections oriented at the acute angle relative to the longitudinal axis.

3. The connector of claim 1, wherein the body includes a first surface and a second surface opposite the first surface, the first surface extending between the first end and the second end, wherein the feature includes an aperture extending through the body between the first surface and the second surface.

4. A connector assembly configured to mechanically and electrically couple at least one frame to a support structure, the connector assembly comprising:

a first connector including, a body including a first end and a second end, the body defining a longitudinal axis extending between the first end and the second end, the body further including a first aperture positioned between the first end and the second end, the body including a first side and a second side, the first side and the second side extending between the first end and the second end and substantially parallel to the longitudinal axis, a first clamping member positioned adjacent the first end of the body, the first clamping member configured to engage one of the at least one frame, and a plurality of projections extending from the body and configured to contact one of the at least one frame, the plurality of projections including a plurality of first projections and a plurality of second projections, the plurality of first projections extending from the first side, the plurality of second projections extending from the second side, the plurality of first projections configured to contact one of the at least one frame, the plurality of second projections configured to contact another of the at least one frame;

a second connector including, a first portion including a distal end, the distal end including teeth configured to engage the support structure, a second portion coupled to the first portion, the second portion including a distal end including teeth configured to engage the support structure, and an intermediate portion positioned between the first portion and the second portion and coupling the second portion to the first portion, the intermediate portion including a second aperture; and a member coupling the first connector to the second connector.

5. The connector assembly of claim 4, wherein the intermediate portion includes a first surface, a second surface opposite the first surface, and the second aperture extending between the first surface and the second surface.

6. The connector assembly of claim 4, wherein the member is a fastener extending through the first aperture and the second aperture in a direction perpendicular to the longitudinal axis.

7. The connector assembly of claim 4, wherein the body of the first connector includes a first side and a second side, the first side and the second end extending between the first end and the second end and substantially parallel to the longitudinal axis, wherein the plurality of projections includes a plurality of first projections and a plurality of second projections, the plurality of first projections extending from the first side, the plurality of second projections extending from the second side, the plurality of first projections configured to contact the first frame, the plurality of second projections configured to contact the second frame.

8. The connector assembly of claim 7, wherein the plurality of first projections are oriented at an acute angle relative to the longitudinal axis, the plurality of second projections oriented at the acute angle relative to the longitudinal axis.

9. The connector assembly of claim 4, wherein the plurality of projections includes at least one first projection and at least one second projection, the at least one first projection extending from the first end, the at least one second projection extending from the second end.

10. The connector assembly of claim 9, wherein the at least one first projection includes a pair of first projections, the first clamping member positioned between the pair of first projections.

11. The connector assembly of claim 9, wherein the body further defines a transverse axis oriented perpendicular to the longitudinal axis, wherein the at least one first projection is oriented at an acute angle relative to the transverse axis, the at least one second projection oriented an the acute angle relative to the transverse axis.

12. The connector assembly of claim 4, wherein the distal end of the first portion includes a hook portion curving toward the distal end of the second portion.

13. The connector assembly of claim 4, wherein the distal end of the first portion includes a U-shaped portion including a terminal edge oriented toward the intermediate portion, the first plurality of projections protruding from the terminal edge.

14. The connector assembly of claim 4, wherein the clamping member is a first clamping member, the first connector further including a second clamping member positioned adjacent the second end of the body and configured to engage another frame.

15. A connector configured to mechanically and electrically couple a first frame to a second frame, the connector comprising:

a body including a first end and a second end, the body defining a longitudinal axis extending between the first end and the second end, the body further including a feature for engaging a fastener;

a first clamping member positioned adjacent the first end of the body, the first clamping member configured to engage the first frame;

a second clamping member positioned adjacent the second end of the body, the second clamping member configured to engage the second frame; and a plurality of projections extending from the body and configured to contact at least one of the first frame and the second frame, wherein the plurality of projections includes at least one first projection and at least one second projection, wherein the at least one first projection includes a pair of first projections, the at least one second projection include a pair of second projections, wherein the first member and the second member extend at an angle from the body, and wherein the plurality of projections extends at a different angle from the body than the first clamping member and the second clamping member.

16. The connector of claim 15, wherein the body further defines a transverse axis oriented perpendicular to the longitudinal axis, wherein the at least one first projection is oriented at an acute angle relative to the transverse axis, the at least one second projection oriented an the acute angle relative to the transverse axis.

17. The connector of claim 15, wherein the body includes a first surface and a second surface opposite the first surface, the first surface extending between the first end and the second end, wherein the feature includes an aperture extending through the body between the first surface and the second surface.

18. The connector of claim 15, wherein the pair of first projections is configured to contact the first frame and the pair of second projections is configured to contact the second frame.

* * * * *